United States Patent [19]

Detert et al.

[11] 3,971,676

[45] July 27, 1976

[54] MAGNETIC MATERIAL OF HIGH STRENGTH AND TOUGHNESS

[75] Inventors: Klaüs Detert; Hans-Jochen Lipp, both of Neu Isenburg, Germany

[73] Assignee: Licentia Patent-Verwaltungs-G.m.b.H., Frankfurt am Main, Germany

[22] Filed: Apr. 19, 1971

[21] Appl. No.: 135,370

[30] Foreign Application Priority Data

Apr. 17, 1970 Germany ..... 2018462

[52] U.S. Cl. ..... 148/121; 75/123 K; 75/128 B; 75/128 T; 75/128 W

[51] Int. Cl.[2] ..... H01f 1/00

[58] Field of Search ..... 148/121, 31.57, 120, 148/122; 310/261; 75/128 B, 128 T, 128 W, 123 K

[56] References Cited

UNITED STATES PATENTS

| | | | |
|---|---|---|---|
| 3,093,519 | 6/1963 | Decker et al. | 75/123 K |
| 3,338,709 | 8/1967 | Baker et al. | 75/123 K |
| 3,532,491 | 10/1970 | Floreen et al. | 75/123 K |
| 2,382,652 | 8/1945 | Nesbitt | 148/31.57 |
| 2,382,653 | 8/1945 | Nesbitt | 148/31.57 |
| 2,441,588 | 5/1948 | Nesbitt | 148/31.57 |
| 2,961,360 | 11/1960 | Kouyel et al. | 148/31.47 |
| 3,314,828 | 4/1967 | Harrison | 148/31.57 |
| 2,549,468 | 4/1951 | Howe | 148/31.57 |
| 2,802,124 | 8/1957 | Sjoblom | 310/261 |
| 3,322,579 | 5/1967 | Leblang | 148/31.57 |
| 3,574,003 | 4/1971 | Nara et al. | 148/120 |
| 3,673,010 | 6/1972 | Matsumoto et al. | 148/31.57 |

*Primary Examiner*—Walter R. Satterfield
*Attorney, Agent, or Firm*—Spencer & Kaye

[57] ABSTRACT

A steel hardening by precipitation in a martensitic matrix and having an iron-nickel, iron-chromium, or iron-manganese basis is austenitized and then subjected to a heat treatment including heating it to at least 500°C. This hardens the steel and at the same time increases its coercive force.

7 Claims, No Drawings

MAGNETIC MATERIAL OF HIGH STRENGTH AND TOUGHNESS

BACKGROUND OF THE INVENTION

The present invention relates to a magnetic material of high strength and toughness.

In hysteresis motors operating at high The such as are used for example for gas-ultracentrifuges, a material having high strength and toughness in addition to good magnetic properties is needed for the rotor. Thus, it is required that the material have a coercive force greater than 40 oersteds, a yield strength of at least 150 kiloponds/mm², and a toughness such that the rotor does not undergo brittle fracture because of small imperfections in the material. the rotor may, for example, be in the form of an annular disc.

It is known that a cobalt-containing alloy named Vicalloy can be used for making the annular discs. However, the required strengths can only be achieved in this material by major cold-working, so that the use of this material is limited solely to relatively thin discs (thicknesses of about 1.8 to 2.5 millimeters), which are produced from cold-worked bands. The toughness of such bands is exceptionally small.

SUMMARY OF THE INVENTION

An obejct of the invention, therefore, is to provide a material having strength, toughness, and coercive force characteristics which make it suitable for use as rotors in hysteresis motors operating at high r.p.m.

This as well as other objects which will become apparent in the discussion that follows are achieved, according to the present invention, by using a steel hardening by precipitation in a martensitic matrix and having an iron-nickel, iron-chromium, or iron-manganese basis. For the purpose of improving the magnetic properties of this steel, it is first austenitized and then subjected to a heat treatment including the step of heating the steel to above 500°C, this step being in addition to the precipitation heat treatment or else in complete replacement of the precipitation heat treatment.

DESCRIPTION OF THE PREFERRED EMBODIMENTS

The usual heat treatment of a 18 weight-percent Ni, 8 weight-percent Co, 5 weight-percent Mo steel which hardens by precipitation in a martensitic matrix essentially involves austenitizing the steel for 1 hour at 810°C following rolling. High strength is obtained by a three-hour precipitation hardening at 480°C and a subsequent cooling in air. The following properties are obtained:

| | |
|---|---|
| Coercive Force $H_c$ | = 18 to 20 oersteds |
| Vickers Hardness, 10 kilopond load | = approx. 560 kiloponds/mm² |
| Yield Strength, 0.2% offset | = approx. 175 kiloponds/mm² |
| Tensile Strength | = approx. 190 kiloponds/mm² |
| Elongation | = approx. 9 to 10% |
| Reduction of Area | = approx. 53% |

This material is given the necessary strength and toughness by the precipitation hardening heat treatment at 480°C, but the required coercive force is not obtained. However, by subjecting this material to an additional heat treatment at a temperature above 500°C according to the present invention, the coercive force is increased and a material meeting the various requirements for application in a hysteresis motor is achieved.

The heat treatment at 500°C according to the present invention gives the precipitation needed for obtaining high strength and it additionally causes a diffusion-controlled decomposition of the martensite. The resulting small particles of austenite in the ferrite matrix yield a coercive force increased over that obtained by only heat treating below 500°C.

An optimum alloy composition for the present invention in as follows: Ni from 12 to 20%, Co from 5 to 20%, remainder iron. Nickel can be partially or completely replaced by chromium or manganese.

An additional improvement in the magnetic properties can be achieved by including the following elements, alone or in combination, in the steel: titanium—up to 1.5%, niobium—5%, molybdenum—up to 8%, tantalum—5%, tungsten—5%, vanadium—5%, beryllium—1%, and aluminum—1%. The total of all those additions should not exceed 5 atomic percent.

The invention is further illustrated by the following examples:

EXAMPLE I

Material: Martensitically hardening 18% Ni steel.
Analysis: 0.015% C, 4.95% Mo, 17.85% Ni, 8.0% Co, 0.1% Al, 0.36% Ti
Initial treatment: Austenitizing by heating for one hour at 810°C, followed by cooling in the air.
Additional heat treatment: 30 minutes at 600°C

| | | |
|---|---|---|
| Properties: | Coercive Force $H_c$ | = 50 oersteds |
| | Vickers Hardness, 10 kilopond load | = 470 kiloponds/mm² |
| | Yield Strength, 0.2% offset | = 150 kiloponds/mm² |
| | Tensile Strength | = 155 kiloponds/mm² |
| | Elongation | = 13.2% |
| | Reduction of Area | = 38% |

EXAMPLE II

The same material with the same composition as in Example I.

The same austenitizing heat treatment as in Example I.

Heat treatment for achieving desired properties: 45 minutes at 600°C + 16 hours at 450°C.

| | | |
|---|---|---|
| Properties: | Coercive Force $H_c$ | = 62 oersteds |
| | Vickers Hardness, 10 kilopond load | = 511 kiloponds/mm² |
| | Tensile Strength | = approx. 170 kiloponds/mm² |

EXAMPLE III

The same material, composition, and austenitizing heat treatment as in Example I.

Heat treatment for achieving desired properties: 2 hours at 650°C + 30 minutes at 810°C + 3 hours at 480°C.

| | | |
|---|---|---|
| Properties: | Coercive Force $H_c$ | = 43 oersteds |
| | Vickers Hardness, 10 kilopond load | = .560 kiloponds/mm² |
| | Yield Strength, 0.2% offset | = 188 kiloponds/mm² |
| | Tensile strength | = 194 kiloponds/mm² |

-continued

| | |
|---|---|
| Elongation | = 14.4% |
| Reduction of Area | = 48% |

All percentages given herein for compositions are percentages by weight, unless otherwise noted.

Tensile strength is defined as the maximum load in a tensile test divided by the original cross-sectional area.

Elongation is defined as the amount of total extension at fracture minus original length expressed as a percentage of the original gage length.

Reduction of area is defined as $$\frac{\text{Original area} - \text{final area at point of fracture}}{\text{Original area}} \cdot 100$$

The steels contemplated for the present invention are firstly those which harden by the precipitation of fine particles in a martensitic matrix during an aging heat treatment, following a preliminary heat treatment to provide an austenite microstructure. When reference is made to such a steel as furthermore having an iron-nickel basis, it is meant that the steel contains at least 65% iron and between 8 to 25% nickel. For an iron-chromium basis, it is meant Cr between 5 to 20%. For an iron-manganese basis, it is meant Mn 1 to 10%. The further limiting of the steel to one having one of these three bases is important for achieving the combined properties of a coercive force of at least 40 oersteds, a tensile strength of at least 150 kiloponds/mm$^2$, and a toughness, as measured by the reduction of area, of at least 15%. Steels that can be used in the present invention include those having a composition of C less than 0.03%, 4 to 6% Mo, 15 to 18% Ni, 8 to 12% Co and 0.3 to 0.8% Ti.

The tensile-test specimens used to obtain the data of the above tables had a gage length of 5 centimeters and a cross sectional area of 0.79 square centimeters over the gage length. They were turned from bars having a 2-centimeter diameter, after heat treatment.

It will be understood that the above description of the present invention is susceptible to various modifications, changes and adaptations, and the same are intended to be comprehended within the meaning and range of equivalents of the appended claims.

What is claimed is:

1. A method for preparing a magnetic material suitable for use in rotors in hysteresis motors operating at high r.p.m. from a martensitically hardening steel consisting essentially of at least about 65% iron and a member of the group of 8 to 25% Ni, 5 to 20% Cr, and 1 to 10% Mn, said rotor having high stability and toughness and increased coercive field strength, comprising the steps of treating the steel by austenitizing said steel and then subjecting it to a heat treatment including heating the steel to at least 500°C for a time sufficient to yield a coercive force, $H_c$, of at least 40 oersteds and provide a tensile strength of at least about 150 kiloponds/mm$^2$ and a toughness as measured by a reduction in area of at least 15%.

2. A method as claimed in claim 1, said steel consisting essentially of 12 to 20% Ni, 5 to 20% Co, and remainder Fe.

3. A method as claimed in claim 1, said steel further containing at least one element selected from the group consisting of titanium, niobium, molybdenum, tungsten, tantalum, vanadium, beryllium, and aluminum.

4. A method as claimed in claim 1, said steel having substantially the following composition: C less than 0.03%, 4 to 6% Mo, 15 to 18% Ni, 8 to 12% Co, and 0.3 to 0.8% Ti; the step of austenitizing being substantially for 1 hour at 810°C; the step of subjecting being a heating substantially for 30 minutes at 600°C.

5. A method as claimed in claim 1, said steel having substantially the following composition: C less than 0.03%, 4 to 6% Mo, 15 to 18% Ni, 8 to 12% Co, and 0.3 to 0.8% Ti; the step of austenitizing being substantially for 1 hour at 810°C; the step of subjecting being heat treating substantially for 45 minutes at 600°C and for 16 hours at 45°C.

6. A method as claimed in claim 1, said steel having substantially the following composition: C less than 0.03% 4 to 6%, Mo, 15 to 18% Ni, 8 to 12% Co, and 0.3 to 0.8% Ti; the step of austenitizing being substantially for 1 hour at 70°C; the step of subjecting being heat treating substantially for 2 hours at 650°C, for 30 minutes at 810°C, and for 3 hours at 480°C.

7. A magnetic material produced according to the process of claim 1.

* * * * *